US011090227B2

(12) United States Patent
Ebrahim et al.

(10) Patent No.: US 11,090,227 B2
(45) Date of Patent: Aug. 17, 2021

(54) CONNECTOR FOR TRANSFERRING THE CONTENTS OF A CONTAINER

(71) Applicant: BIO-RAD LABORATORIES, INC., Hercules, CA (US)

(72) Inventors: Alireza Ebrahim, Laguna Niguel, CA (US); Karl De Vore, Coto De Caza, CA (US); John Sass, Irvine, CA (US)

(73) Assignee: Bio-Rad Laboratories, Inc., Hercules, CA (US)

( * ) Notice: Subject to any disclaimer, the term of this patent is extended or adjusted under 35 U.S.C. 154(b) by 428 days.

(21) Appl. No.: 15/996,291

(22) Filed: Jun. 1, 2018

(65) Prior Publication Data

US 2019/0365605 A1 Dec. 5, 2019

(51) Int. Cl.
*A61J 1/20* (2006.01)
*B65D 81/32* (2006.01)

(52) U.S. Cl.
CPC ..... *A61J 1/2089* (2013.01); *A61J 1/2096* (2013.01); *A61J 1/2013* (2015.05); *A61J 1/2055* (2015.05); *B65D 81/3211* (2013.01)

(58) Field of Classification Search
CPC ..... A61J 1/2089; A61J 1/2013
See application file for complete search history.

(56) References Cited

U.S. PATENT DOCUMENTS 5,653,686 A 8/1997 Coulter et al.
5,743,312 A * 4/1998 Pfeifer ..... A61J 1/2089 141/329
6,699,229 B2 3/2004 Zinger et al.
7,077,835 B2 * 7/2006 Robinson ..... A61J 1/2089 604/413
7,297,140 B2 * 11/2007 Orlu ..... A61J 1/2089 215/277
7,456,024 B2 * 11/2008 Dahm ..... B01J 19/249 436/164

(Continued)

FOREIGN PATENT DOCUMENTS

EP 1219283 A2 7/2002
EP 1829518 A1 9/2007

OTHER PUBLICATIONS

Extended European Search Report from EPO Patent Application No. 19175851.5 dated Sep. 5, 2019.

*Primary Examiner* — Leslie R Deak
(74) *Attorney, Agent, or Firm* — Kilpatrick Townsend & Stockton LLP

(57) ABSTRACT

Methods and devices for transferring materials between containers are discussed. One such connector includes: a base; a first elongate structure having first and second ends, the first elongate structure extending from a first side of the base at the first end to the second end distal the base, the second end forming a first opening sized and configured to receive a first container; a duct extending through the base and having a first tip skirted on one or more sides by the first elongate structure; a first guard positioned within the first elongate structure, wherein the first guard comprises a first surface, and the first surface is located further away from the base than the first tip. When the first container is moved into the first opening, the first surface moves toward the base, and the first tip enters the first container, creating a fluid path for the first container.

16 Claims, 13 Drawing Sheets

(56) References Cited

U.S. PATENT DOCUMENTS

| | | | | |
|---|---|---|---|---|
| 8,545,476 | B2 * | 10/2013 | Ariagno | A61J 1/2089 604/414 |
| 9,033,949 | B2 * | 5/2015 | Olesen | A61J 1/1406 604/414 |
| 9,354,144 | B2 | 5/2016 | Ebrahim et al. | |
| 9,599,543 | B2 | 3/2017 | Ebrahim et al. | |
| 9,636,277 | B2 | 5/2017 | Foshee et al. | |
| 9,662,271 | B2 | 5/2017 | Holt et al. | |
| 2002/0123736 | A1 * | 9/2002 | Fowles | A61J 1/1406 604/413 |
| 2004/0059312 | A1 * | 3/2004 | Frezza | A61J 1/065 604/411 |
| 2015/0148255 | A1 | 5/2015 | U'ren | |
| 2017/0038400 | A1 | 2/2017 | Ebrahim et al. | |

* cited by examiner

CONNECTOR FOR TRANSFERRING THE CONTENTS OF A CONTAINER

TECHNICAL FIELD

This disclosure relates devices for transferring the contents of one container into another container.

BACKGROUND

Transferring contents of containers can be a part of many operations, such as the preparation of reagents, buffer preparation, stock solution preparation, preparation of samples for testing, etc. In some examples of transferring contents of containers, material in one container can be transferred to another container containing another material which can be a fluid or a solid. Transferring the material from a container can result in the loss of at least a portion of the material being transferred, the contamination of the material or exposure of personnel or equipment to the material being transferred. In addition, particular instances of materials transfers can be constrained by requirements of accuracy and reproducibility as well as timing constraints.

It is desirable to have devices and methods that can assist in transferring material from a container and that can in some cases reduce potential for contamination or exposure, improve safety or to simplify or streamline the transfer.

SUMMARY

In a first aspect disclosed herein a material transfer connector is provided, the material transfer connector comprising: a base; a first elongate structure having first and second end, the first elongate structure extending from a first side of the base at the first end to the second end distal the base, the second end forming a first opening sized and configured to receive a first container; a second elongate structure having a third and fourth end, the second elongate structure extending from a second side of the base at the third end to the fourth end distal the base, the fourth end forming a second opening sized and configured to receive a second container; a duct extending through the base and having a first tip skirted on one or more sides by the first elongate structure and a second tip skirted on one or more sides by the second elongate structure; a first guard positioned within the first elongate structure, wherein the first guard comprises a first surface, and the first surface is located further away from the base than the first tip; and a second guard positioned within the second elongate structure, wherein the second guard comprises a second surface, and the second surface is located further away from the base than the second tip; wherein, when the first container is moved into the first opening, the first surface moves toward the base, and the first tip enters the first container, and when the second container is moved into the second opening, the second surface moves toward the base, and the second tip enters the second container, creating a fluid path between the first and the second containers.

In a second aspect, a method of transferring a fluid between containers, the method comprising: moving a first container into the first opening of a material transfer connector, wherein the material transfer connector comprises: a base; a first elongate structure having first and second ends, the first elongate structure extending from a first side of the base at the first end to the second end distal the base, the second end forming a first opening sized and configured to receive a first container; a second elongate structure having a third and fourth end, the second elongate structure extending from a second side of the base at the third end to the fourth end distal the base, the fourth end forming a second opening sized and configured to receive a second container; a duct extending through the base and having a first tip skirted on one or more sides by the first elongate structure and a second tip skirted on one or more sides by the second elongate structure; a first guard positioned within the first elongate structure, wherein the first guard comprises a first surface, and the first surface is located further away from the base than the first tip; and a second guard positioned within the second elongate structure, wherein the second guard comprises a second surface, and the second surface is located further away from the base than the second tip; wherein, when the first container is moved into the first opening, the first surface moves toward the base, and the first tip enters the first container, and when the second container is moved into the second opening, the second surface moves toward the base, and the second tip enters the second container, creating a fluid path between the first and the second containers, and the first surface moves toward the base and the first tip enters the first container and creates a fluid path between the first container and a second container present in the second opening; and transferring fluid between the first and second containers In a third aspect, a material transfer connector is provided, the material transfer connector comprising: a base; a first elongate structure having first and second ends, the first elongate structure extending from a first side of the base at the first end to the second end distal the base, the second end forming a first opening sized and configured to receive a first container; a duct extending through the base and having a first tip skirted on one or more sides by the first elongate structure; a first guard positioned within the first elongate structure, wherein the first guard comprises a first surface, and the first surface is located further away from the base than the first tip; and wherein, when the first container is moved into the first opening, the first surface moves toward the base, and the first tip enters the first container, creating a fluid path for the first container.

DETAILED DESCRIPTION

Figure 1:
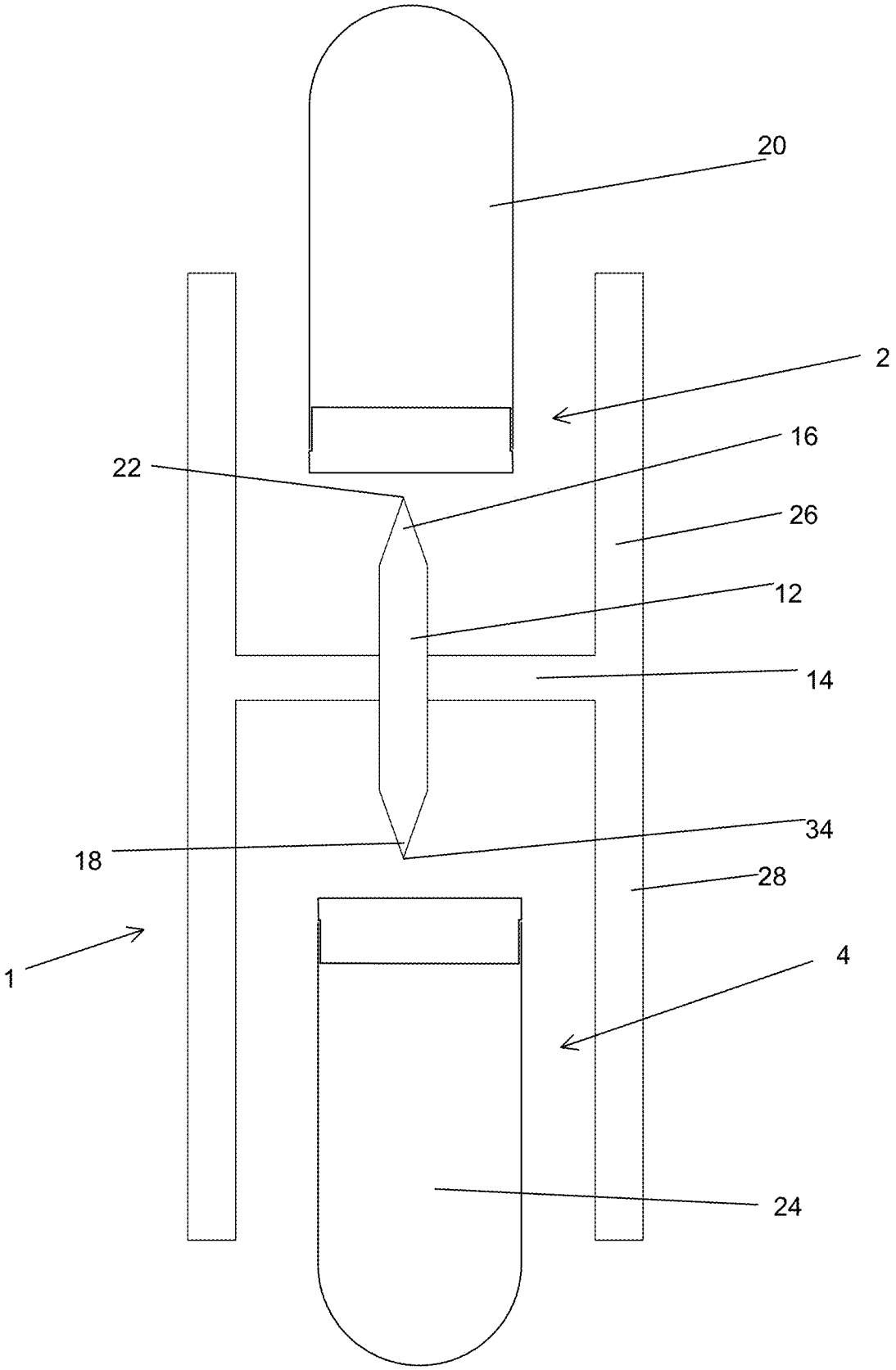
FIG. 1 shows a schematic of an embodiment of a material transfer connector.

In the following description, numerous specific details are set forth to clearly describe various specific embodiments disclosed herein. One skilled in the art, however, will understand that the presently claimed invention may be practiced without all of the specific details discussed below. In other instances, well known features have not been described so as not to obscure the invention.

Some uses of material transfer apparatus can include use with quality control materials or be in a quality control setting. Commercially available quality control materials can be used in the clinical diagnostics laboratories to monitor the precision and accuracy of both manual and automated clinical test methods and procedures. These controls can be prepared by spiking various analytes (e.g. drugs, hormones, enzymes, antibodies, etc.) into a base matrix containing various additives such as stabilizers and antimicrobial agents and are offered in liquid and lyophilized formats. Processed human base matrices such as human serum or human urine can be used in some embodiments for manufacturing of quality controls in order to ensure that the controls are as sensitive as the actual patient samples to anticipated analytical variances. Quality controls can be offered as single analyte or multi-analyte controls in bi-level or tri-level configurations to monitor and challenge the performance of the test methods at above, near, and below the medical decision point for each assay. In some embodiments, controls can have analyte lists that contain related analytes, for example tumor markers, or analytes measured by one type of detection technology, for example, routine chemistry analytes measured by photometry or urinalysis analytes measured by reflectance photometry using dry chemistry strips. In some cases, controls can be originally designed, developed, and optimized to address the needs of a few popular test methods and technologies (e.g. analyte concentration, number of control levels, etc.), and can be changed as the detection technologies change. In addition, quality control materials can be designed to be stable, provide lot-to-lot reproducibility, and be cost effective.

Several embodiments of methods or processes can be envisioned for preparing customized controls, which can quickly and easily be prepared on demand at the point of use and can meet the quality control needs of a lab with regards to the following requirements:

- Number of control levels
- Number of analytes in the control
- Concentration of analyte in the control
- Base matrix used in the control
- Shelf life of the control (typically limited to the least stable analyte(s) in the current state of the art)

It can be desirable for embodiments of these methods or processes to be configured for the reconstitution of the dry material (such as lyophilized bead(s)) to reduce the amount of manual handling and transferring of liquids to the lyophilized bead or vice versa.

In some instances, the amount of manual handling or transferring of materials (whether dry or fluid) can be reduced by the use of a connector between the containers holding the components to be combined, where the connector allows one material to pass from one container, through the connector and to the other container. Such a connector can in some embodiments facilitate the introduction of a volume of the base matrix (solid or fluid) to analyte beads (or other solid or fluid) in order to reconstitute the analyte beads or combine the materials and prepare the quality control material. In some embodiments, the base matrix and/or the analyte beads (or other solid or fluid) can be premeasured and charged to the containers to be used with the connector.

A material transfer connector can be configured to interface with a container, such as a bottle, flask, test tube, beaker, syringe, jar, pipette, or other container, whether closed or open. A material transfer connector can also be configured to interface with equipment, such as a reactor, tank, chromatography system, or other piece of laboratory, industrial or analytic equipment. In some embodiments, a material transfer connector can interface with two containers, two pieces of equipment or a container and a piece of test equipment. In some embodiments, the material transfer connector can facilitate the transfer of a fluid or solid or combination thereof in one container to a container holding a fluid, a solid, or a combination thereof.

FIG. 1 shows an embodiment of a material transfer connector where a duct 12 passes through a base 14. Duct 12 can have a first tip 16 configured, for example, to interface with a first container 20 or with a piece of equipment. In some embodiments, the first tip can be blunt. In some embodiments, the first tip can be sharp. In some embodiments, the first tip can be configured to interface with medical equipment such as by being configured to include a male or a female luer (or luer lock) connection. In some embodiments, the first tip 16 can be configured to pierce a top or to pierce a top comprising a membrane that closes the first container 20. In some embodiments, the first tip can end in a sharp point with an opening located at or adjacent the apex 22 of the sharp point. In some embodiments, the duct 12 can be a double-ended needle or a hypodermic needle.

In some embodiments of a material transfer connector, a duct 12 can have a second tip 18 which is configured to interface a second container 24 or a piece of equipment. The second tip 18 can be of any appropriate design, such as those described herein for the first tip 16, where the design of the first tip 16 and the second tip 18 are independently selected.

In some embodiments, a first elongate structure 26 can extend from the base 14 at a first end 48 of the first elongate structure 26 to a second end 46 of the first elongate structure 26 in a position to skirt the first tip 16 on one or more sides. The first elongate structure 26 can extend parallel to the duct 12 and can serve as a guide for a first container 20, such as by interfacing with an end of the first container 20 or a side of the first container 20 or a side and an end of first container 20 to assist in aligning the first container 20 with the duct 12. In some embodiments, the elongate structure 26 can align the first container 20 radially in relation to the duct 12, the first tip 16 or the apex 22 of the first tip 16. In some embodiments, the first elongate structure 26 can align the first container 20 angularly in relation to the duct 12, the first tip 16 or the apex 22 of the first tip 16. In some embodiments, the alignment (radially and/or angularly) of the first container can locate the first container 16 in order for the first tip 16 to enter the first container 20 at a predetermined location, such as through a penetrable lid 30 on the first container 20.

Penetrable lids can be resealable or non-resealable. In some embodiments, the lid 30 can comprise an elastomeric or plastic material, such as at the predetermined point. Elastomeric materials can be any suitable elastomeric material, such as those that are chemically and structurally compatible with the intended contents and storage conditions (e.g. temperature, pressure, vacuum, etc.). Elastomeric materials can include, for example, rubber (natural or synthetic) as well as other types of elastomeric materials such as urethanes, nitrile, butyl rubber, halogenated butyl rubber, chloroprene, polybutadiene, etc. In some embodiments, the elastomeric material can be in the form of a membrane, such as can be used in a medical vial, configured for piercing by a hypodermic needle. Plastic materials can be any suitable plastic material, including hard and soft plastics, such as materials that are chemically and structurally compatible with the intended contents and storage conditions (e.g. temperature, pressure, vacuum, etc.).

In some embodiments, the elongate structure 26 can be located along duct 12 on only one side of duct 12 and can be configured to allow a first container to move along duct 12 in a position for the first tip to enter the first container, such as by the first tip piercing lid 30 of the first container 20.

In some embodiments, the lid 30 can extend into the opening of the first or second container 20, 24. The lid 30 can extend entirely or partially into the first or second container 20, 24. In some embodiments, an elastomeric lid 30 or an elastomeric portion of lid 30 can extend into the first or second container. In some embodiments, the lid 30 can seal against a top of first or second container or against an interior surface of first or second container. In some embodiments such as that shown in FIG. 8, lid 30 can have one or more lobes 64 which extend into first or second container to affix or assist in affixing lid 30 to first or second container. The embodiments of lids 30 can include a penetrable portion 66, such as the lid 30 shown in FIG. 8. In some embodiments, the penetrable portion 66 can, for example, can be configured to be penetrated by duct 12 or a tip of duct 12. In some embodiments, penetrable portion 66 can be thinner or softer than an adjacent portion of lid 30 or otherwise more easily penetrated than an adjacent portion of lid 30.

Figure 8:
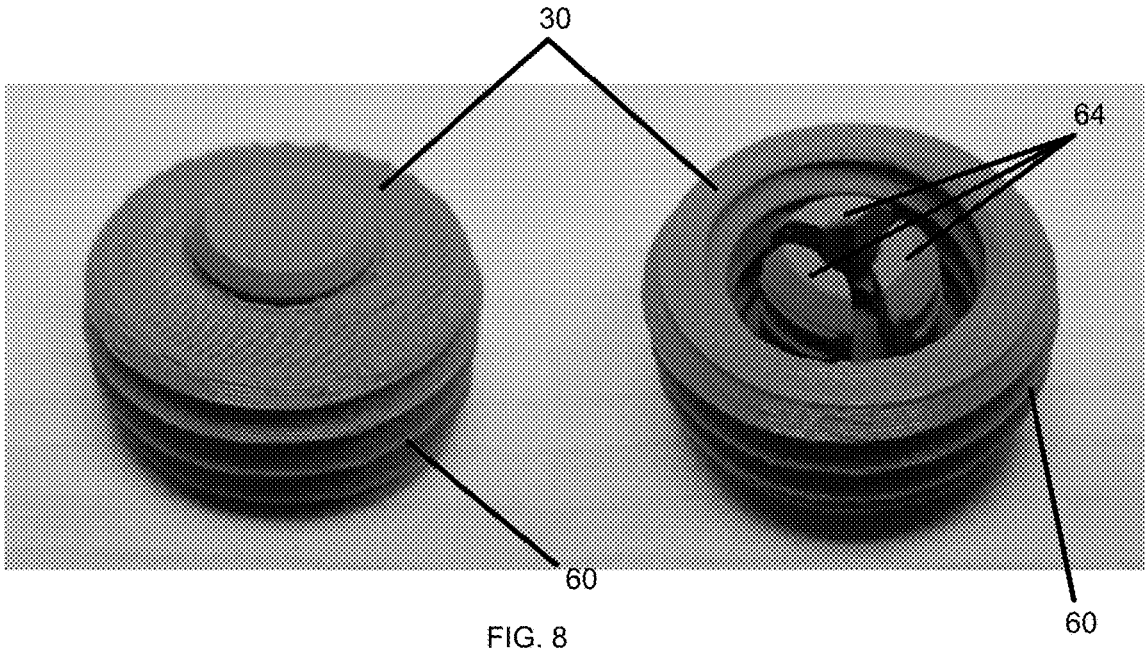
FIG. 8 shows photographs of an embodiment of a lid.
Figure 9:
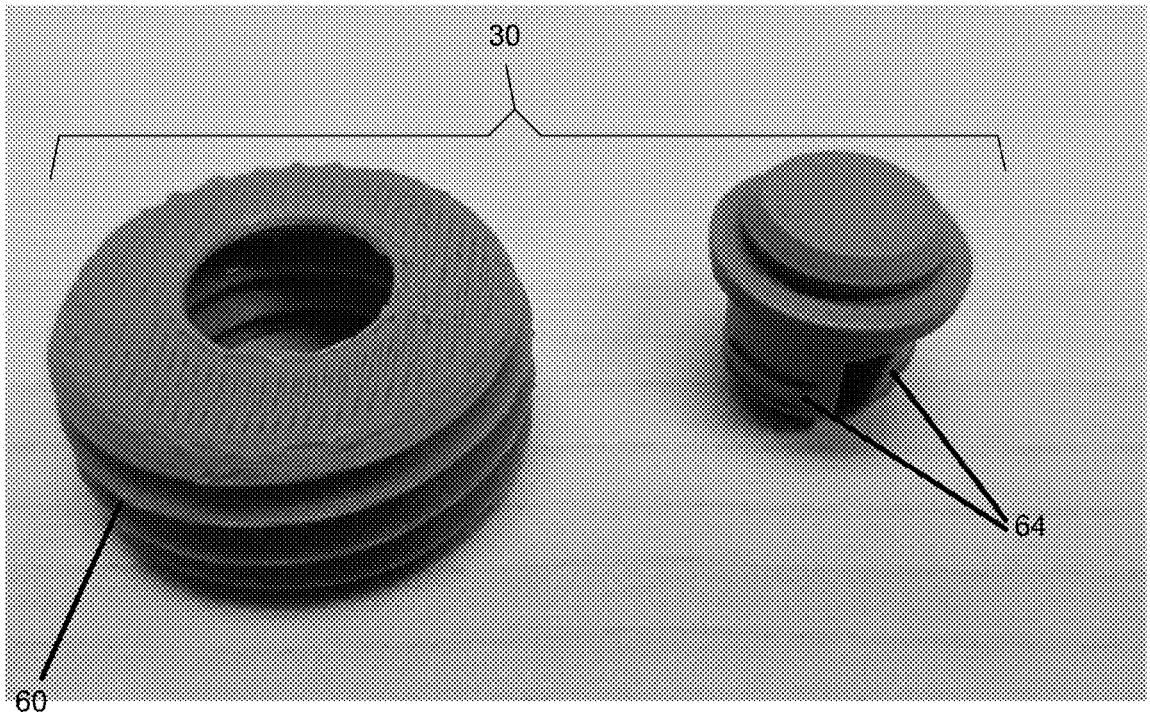
FIG. 9 shows photographs of components of an embodiment of a lid.
Figure 10:
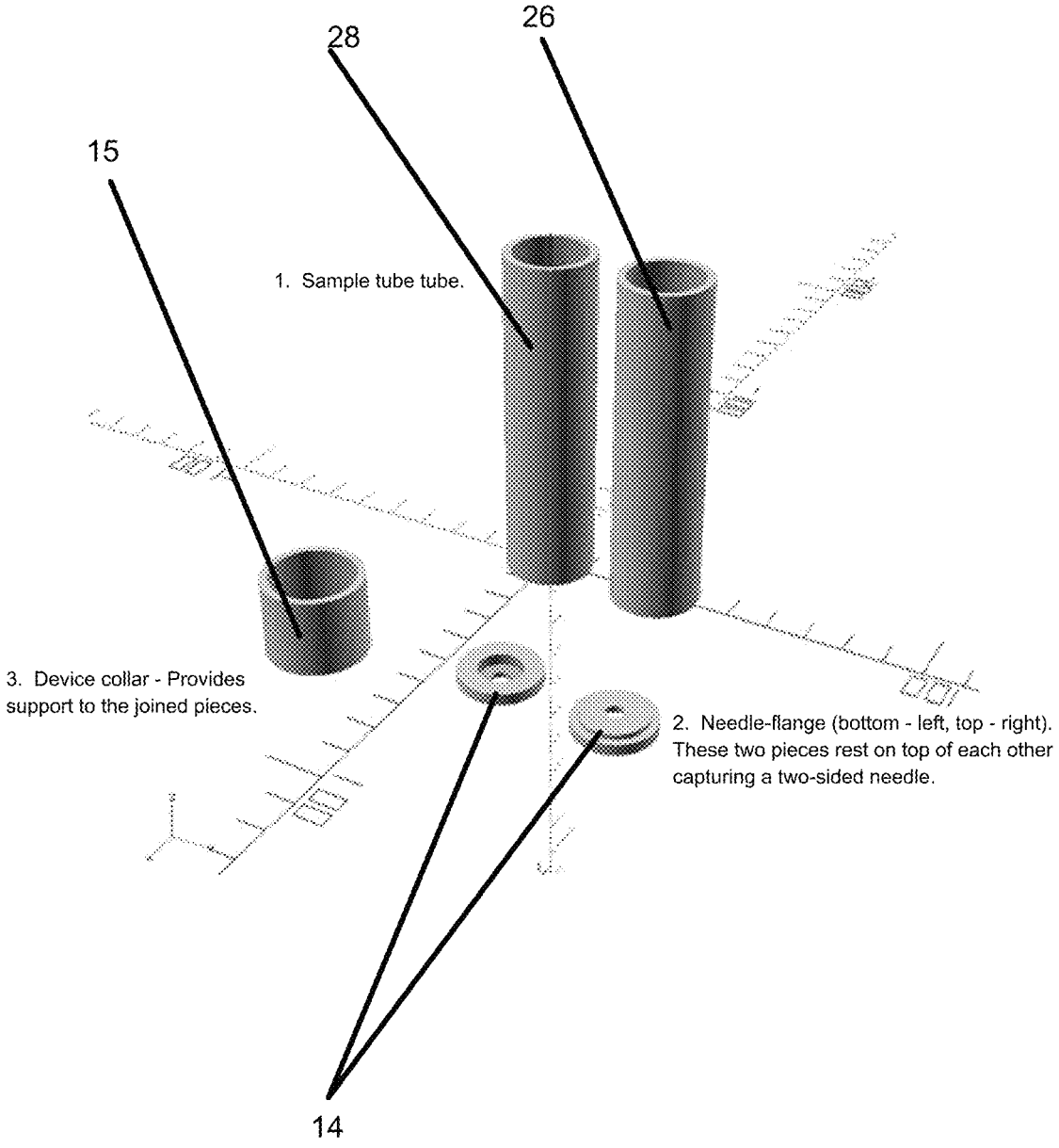
FIG. 10 shows schematics of components of an embodiment of a material transfer connector.
Figure 11:
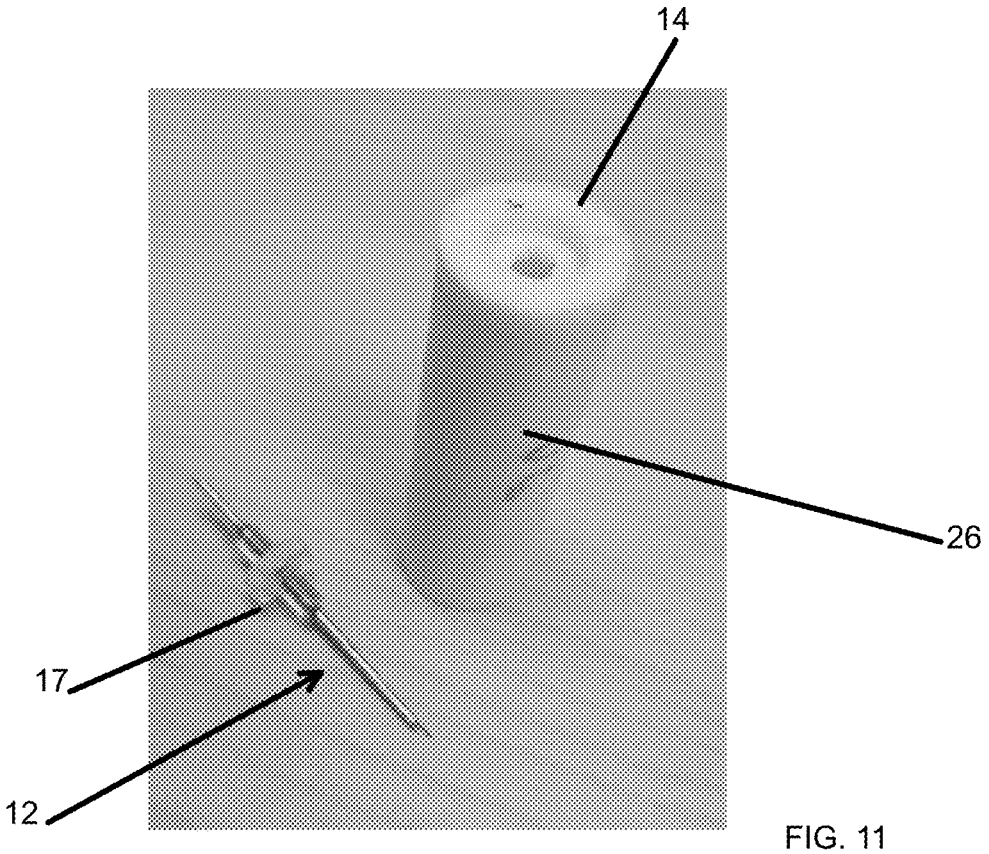
FIG. 11 shows a photograph of a partially assembled embodiment of a material transfer connector.
Figure 12:
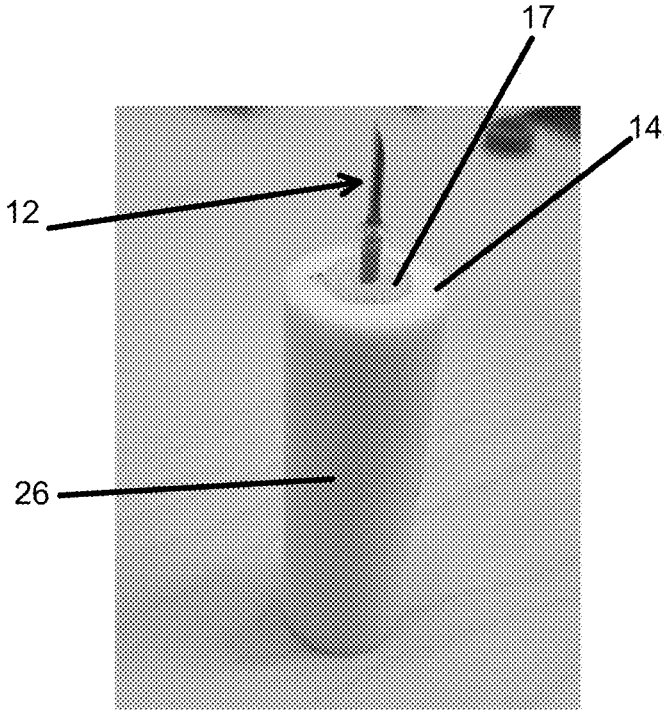
FIG. 12 shows a photograph of a partially assembled embodiment of a material transfer connector.

In some embodiments of a lid 30, external threads 60 can be present. FIGS. 8 and 9 show an embodiment of a lid 30 having external threads 60. As shown in FIG. 9, external threads 60 can be separable from other portions of lid 30. In other embodiments, external threads 60 can be non-separable from other portions or the rest of lid 30. In some embodiments, external threads 60 can be made integral to lid 30, such as by molding, casting or the like. In some embodiments, external threads 60 can be fused to other portions of lid 30, such as by gluing, cementing, melting, welding, etc.

In some embodiments, the elongate structure 26 can be located on two or more sides of duct 12, such as by being comprised of two or more portions extending from base 14 at different locations on base 14. In some embodiments, multiple portions of elongate structure 26 can be positioned to skirt duct 12 by being positioned around duct 12 at two or more locations. In some embodiments, multiple portions of elongate structure 26 can be positioned to skirt duct 12 by forming a fence or wall around at least a portion of duct 12. In some embodiments, elongate structure 26 can comprise a plurality of separate portions extending from base 14.

In some embodiments, elongate structure 26 can wrap either entirely around duct 12, such as by being in the form of a cylinder or other closed structure (e.g. oval or polygonal) or partially around duct 12, such as by being in the form of a curved wall.

In some embodiments, the elongate structure can extend from the base 14 for a distance approximately equal to the distance the duct 12 extends from the base 14 into the first opening 2 or 1-2× or 2-3× or 3-4× or more times this distance. In some embodiments, the elongate structure 26 can extend from base 14 for less than the distance the duct 12 extends from the base 14 into the first opening 2. In some embodiments, the elongate structure 26 can extend a sufficient distance from base 14 for alignment of duct 12 to first container 20 and/or lid 30 of first container 20 prior to duct 12 contacting or entering first container 20 or lid 30 of first container 20. In some embodiments, the elongate structure 26 can align the first container by skirting the first container 20 on a sufficient number of sides (or over a sufficient portion of the circumference of first container 20 to limit the radial positioning of first container 20 for first tip 16 to enter first container 20 or its lid 30 at a predetermined point or within an acceptable margin of the predetermined point. In some embodiments, the predetermined point or the predetermined point and acceptable margin can be a region that is thinner and/or of a different material or otherwise more easily penetrated than adjacent areas of lid 30 or first container 20. In some embodiments, the elongate structure 26 can align the first container 20 angularly by skirting duct 12 and interacting with an end or a side of container 20 to limit changes the angular position of container 20 in relation to duct 12 or first tip 16, such as for the first tip 16 to enter container 20 through an area of low or no obstruction. In some embodiments, misalignment can result in first tip 16 contacting or being blocked by a portion of an end or a side of container 20 while the first container 20 is being moved into the first opening or along the first elongate structure 26 toward first tip 16. In some embodiments, misalignment can result in first tip 16 attempting to pass through a portion of lid 30 that is thicker than at the predetermined point or that is harder or otherwise more difficult for the first tip 16 to penetrate than the predetermined point.

In some embodiments, the connector 1 can have a second elongate structure 28 that can extend from the base 14 at a first end 52 of the second elongate structure 28 to a second end 50 of the second elongate structure 28 in a position to skirt the second tip 18 on one or more sides. In some embodiments, the second elongate structure 28 can extend parallel to the duct 12 and can serve as a guide for a second container 24, such as by interfacing with an end of the second container 24 or a side of the second container 24 or a side and an end of second container 24 to assist in aligning the second container 24 with the duct 12. In some embodiments, the second elongate structure 28 can align the second container 24 radially in relation to the duct 12, the second tip 18 or the apex 34 of the second tip 18. In some embodiments, the second elongate structure 28 can align the second container 24 angularly in relation to the duct 12, the second tip 18 or the apex 34 of the second tip 18. In some embodiments, the alignment (radially and/or angularly) of the second container can locate the second container 24 in order for the second tip 18 to enter the second container 24 at a predetermined location, such as through a penetrable lid 30 on the second container 24.

In some embodiments, the second elongate structure 28 can be located along duct 12 on only one side of duct 12 and can be configured to allow a second container to move along duct 12 in a position for the first tip to en2.

In some embodiments, the second elongate structure 28 can be located on two or more sides of duct 12, such as by being comprised of two or more portions extending from base 14 at different locations on base 14. In some embodiments, multiple portions of second elongate structure 28 can be positioned to skirt duct 12 by being positioned around duct 12 at two or more locations. In some embodiments, multiple portions of second elongate structure 28 can be positioned to skirt duct 12 by forming a fence or wall around at least a portion of duct 12. In some embodiments, second elongate structure 28 can comprise a plurality of separate portions extending from base 14.

In some embodiments, second elongate structure 28 can wrap either entirely around duct 12, such as by being in the form of a cylinder or other closed structure (e.g. oval or polygonal) or partially around duct 12, such as by being in the form of a curved wall.

In some embodiments, the second elongate structure 28 can extend from the base 14 for a distance approximately equal to the distance the duct 12 extends from the base 14 into the second opening 4 or 1-2× or 2-3× or 3-4× or more times this distance. In some embodiments, the second elongate structure 28 can extend from base 14 for less than the distance the duct 12 extends from the base 14 into the second opening 4. In some embodiments, the second elongate structure 28 can extend a sufficient distance from base 14 for alignment of duct 12 to second container 24 and/or lid 30 of second container 24 prior to duct 12 contacting or entering second container 24 or lid 30 of second container 24. In some embodiments, the second elongate structure 28 can align the first container by skirting the second container 24 on a sufficient number of sides (or over a sufficient portion of the circumference of second container 24 to limit the radial positioning of second container 24 for second tip 18 to enter second container 24 or its lid 30 at a predetermined point or within an acceptable margin of the predetermined point. In some embodiments, the predetermined point or the predetermined point and acceptable margin can be a region that is thinner and/or of a different material or otherwise more easily penetrated than adjacent areas of lid 30 or second container 24. In some embodiments, the second elongate structure 28 can align the second container 24 angularly by skirting duct 12 and interacting with an end or a side of second container 24 to limit changes the angular position of second container 24 in relation to duct 12 or second tip 18, such as for the second tip 18 to enter second container 24 through an area of low or no obstruction. In some embodiments, misalignment can result in second tip 18 contacting or being blocked by a portion of an end or a side of second container 24 while the second container 24 is being moved into the second opening or along the second elongate structure 28 toward second tip 18. In some embodiments, misalignment can result in second tip 18 attempting to pass through a portion of lid 30 that is thicker than at the predetermined point or that is harder or otherwise more difficult for the second tip 18 to penetrate than the predetermined point.

Figure 13:
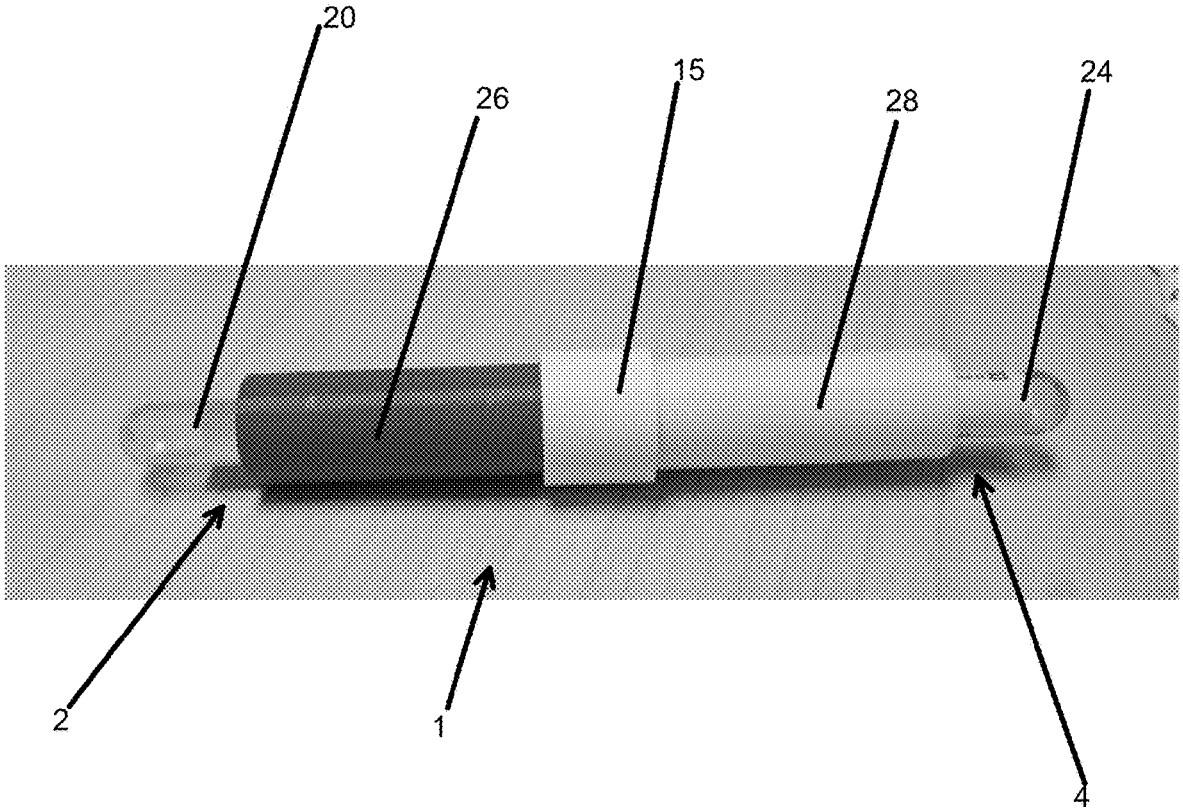
FIG. 13 shows a photograph of an embodiment of a material transfer connector.

FIGS. 10-13 show the parts and assembly of one embodiment of a material transfer connector. Here, first and second elongate structures 26, 28 are hollow cylinders and base 14 is comprised of two pieces that trap the flange 17 of a flanged two-ended needle therebetween. An outer sleeve 15 fits around the base 14 and the first ends 48, 52 of the first and second elongate structures 26, 28. The assembled material transfer connector 1 is shown in FIG. 13 with first and second containers 20, 24 positioned in the first and second openings 2, 4 of the material transfer connector 1.

Guard

In some embodiments of a material transfer connector 1, it can be desirable to design the material transfer connector 1 to reduce the likelihood of poking or otherwise injuring a person with the first tip 16 or second tip 18, such as by a fingerstick. In some embodiments, the first elongate structure 26 and/or second elongate structure 28 can be configured to define a channel 6 where a transverse opening dimension 8, such as an opening diameter limits the travel of a finger or other item along the inside of the first and/or second elongate structure 26, 28. In some embodiments, the transverse opening dimension and the distance between the second end 46, 50 of the first or second elongate structure 26, 28 and the first or second tip 16, 18 can be configured to limit the travel of a finger or other item with in the first opening 2 or second opening 4 and reduce the likelihood of a finger or other item contacting the first or second tip 16, 18.

Figure 2:
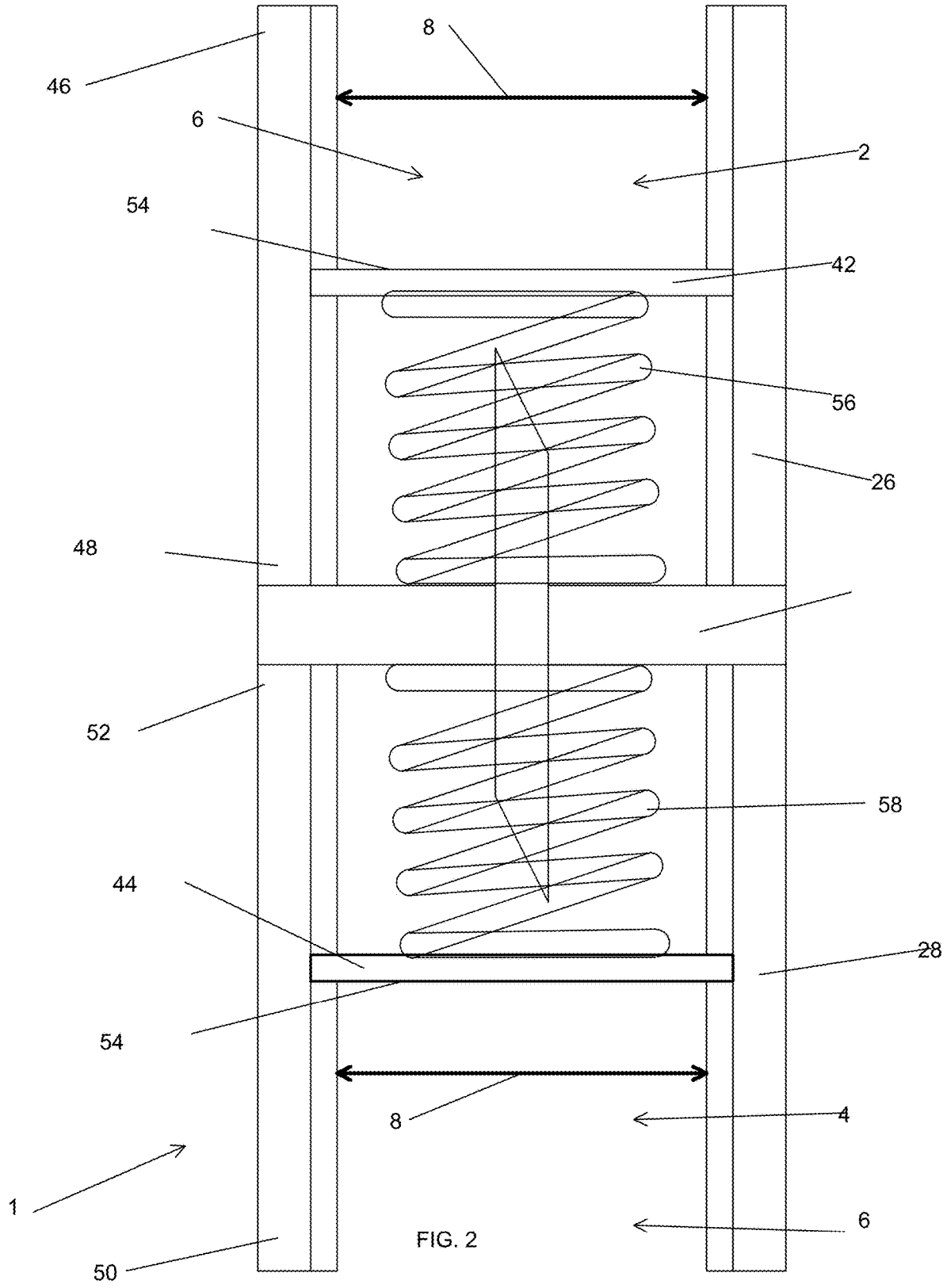
FIG. 2 shows a schematic of an embodiment of a material transfer connector.
Figure 3:
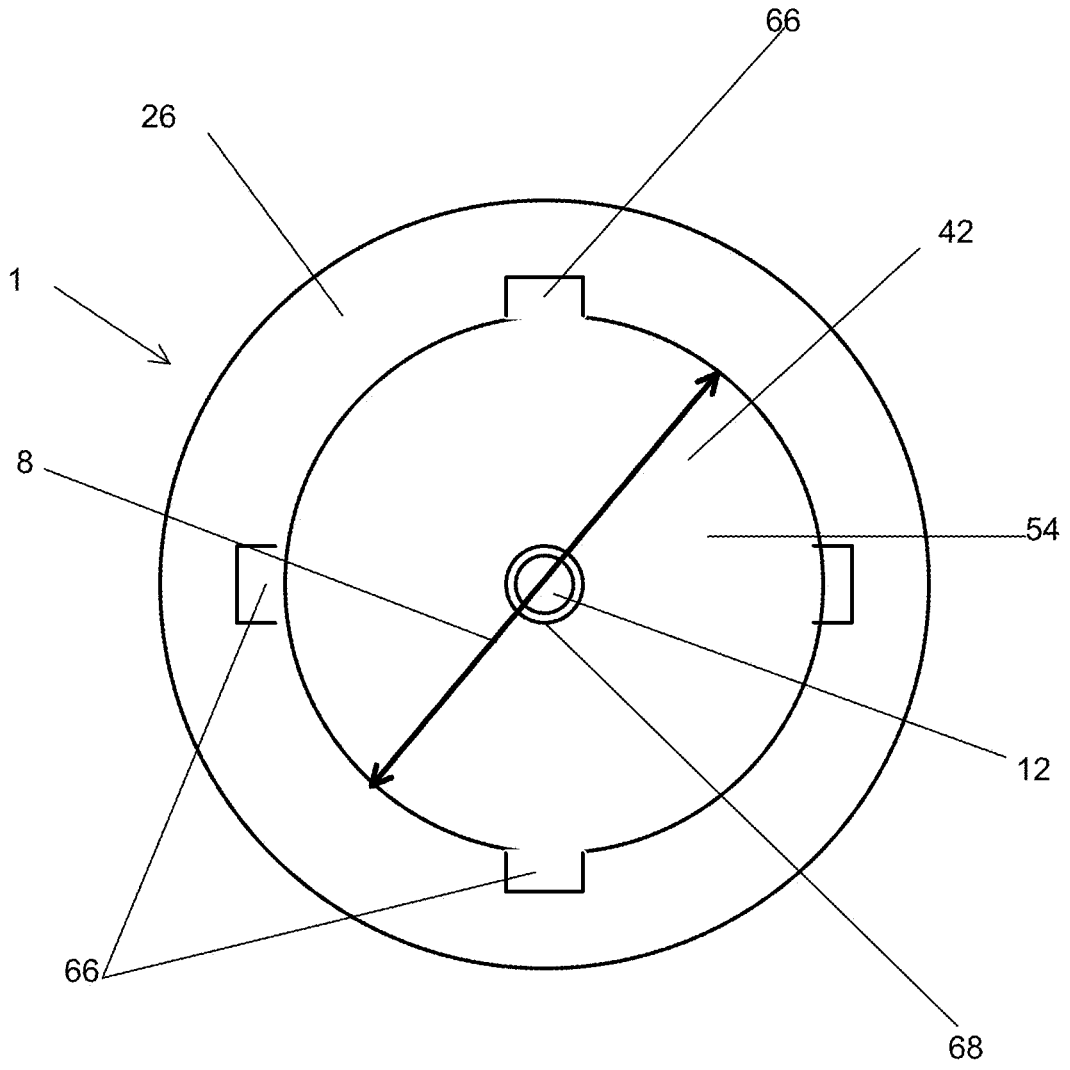
FIG. 3 shows a plan view schematic of an embodiment of a material transfer connector.

In some embodiments of a material transfer connector 1, a guard can be used to reduce the likelihood of a finger or other item contacting first or second tip 16, 18. In some embodiments of a guard, a first guard 42 can comprise a first surface 54 that is positioned between the base 14 and the second end 46 of the first elongate structure 26. The first surface 54 can be positioned between a tip of the duct and the second end of the elongate structure. FIG. 2 shows a first surface 54 of the first guard 42 located between the first tip 16 and the second end 46 of the first elongate structure. In this location, the first guard 42 covers the first tip 16, in that the first tip 16 is below the first surface 54 of the first guard 42. When a first container 20 is moved into the first opening 2, along the first elongate structure 26 and along channel 6 toward the duct 12 and first tip 16, the end of first container 20 can push the first surface 54 of the first guard 42 toward the base 14, exposing the first tip 16 to the first container 20 and optionally lid 30 of first container 20. As the first tip 16 is exposed, it can enter first container 20, such as by passing through lid 30 for example by penetrating a penetrable membrane in lid 30. FIG. 3 shows a top view of the material transfer connector 1, with first elongate structure 26, duct 12, guard 42 and top surface 54 visible as well as optional tabs 66 and optional opening 68 in guard 42 which allows passage of duct 12 through the guard 42. The tabs of the guard 42 fit into slots in the first elongate structure 26 to provide alignment.

In some embodiments, the first guard 42 can be or comprise a solid material or a compressible material. Suitable solid materials can include metals, woods, plastics, elastomers or other materials that are substantially non-compressible material under conditions of use. Suitable compressible materials can include foams such as closed cell or open cell foams or other material that is sufficiently soft to be compressed by the first container 20 as it enters the first opening 2 and presses against the first surface 54 of first guard 42.

In some embodiments, the material transfer connector 1 can also comprise a spring positioned between the base 14 and the guard. In FIG. 2, a first spring 56 is located between the base 14 and first guard 42. In various embodiments, the guard used with a spring can be a compressible material or a non-compressible material. In some embodiments, both a compressible and a non-compressible material can be used with a spring.

As shown in FIG. 2 is a second guard 44 with a first surface 54 of the second guard 44. In some embodiments material transfer connector 1, the material transfer connector 1 can comprise a second guard 44 that comprises a first surface 54 that is positioned between the base 14 and the second end 46 of the second elongate structure 28. The first surface 54 can be positioned between a tip of the duct and the second end of the second elongate structure 28. FIG. 2 shows a first surface 54 of the second guard 44 located between the second tip 18 and the second end 48 of the second elongate structure 28. In this location, the second guard 44 covers the second tip 18, in that the second tip 18 is below the first surface 54 of the second guard 44. When a second container 24 is moved into the second opening 4, along the second elongate structure 28 toward the duct 12 and second tip 18, the end of second container 24 can push the first surface 54 of the second guard 44 toward the base 14, exposing the second tip 18 to the second container 24 and optionally lid 30 of second container 24. As the second tip 18 is exposed, it can enter second container 24, such as by passing through lid 30 for example by penetrating a penetrable membrane in lid 30.

In some embodiments, the second guard 44 can be or comprise a solid material or a compressible material. Suitable solid materials can include metals, woods, plastics, elastomers or other materials that are substantially non-compressible material under conditions of use. Suitable compressible materials can include foams such as closed cell or open cell foams or other material that is sufficiently soft to be compressed by the second container 24 as it enters the first opening 2 and presses against the first surface 54 of first guard 44. In FIG. 2, also shown is a second spring 58 is located between the base 14 and second guard 44.

Figure 4:
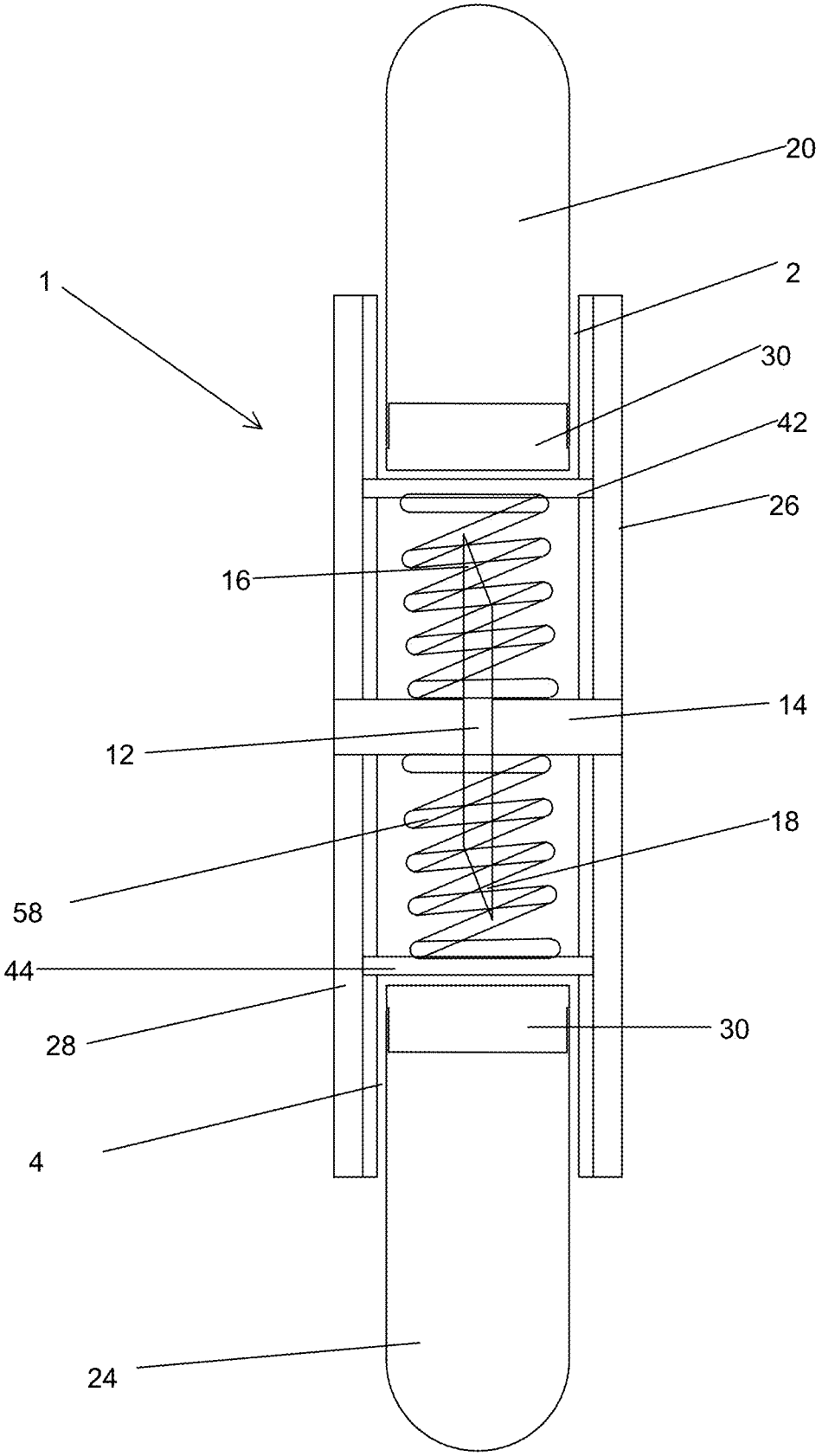
FIG. 4 shows a schematic of an embodiment of a material transfer connector.
Figure 5:
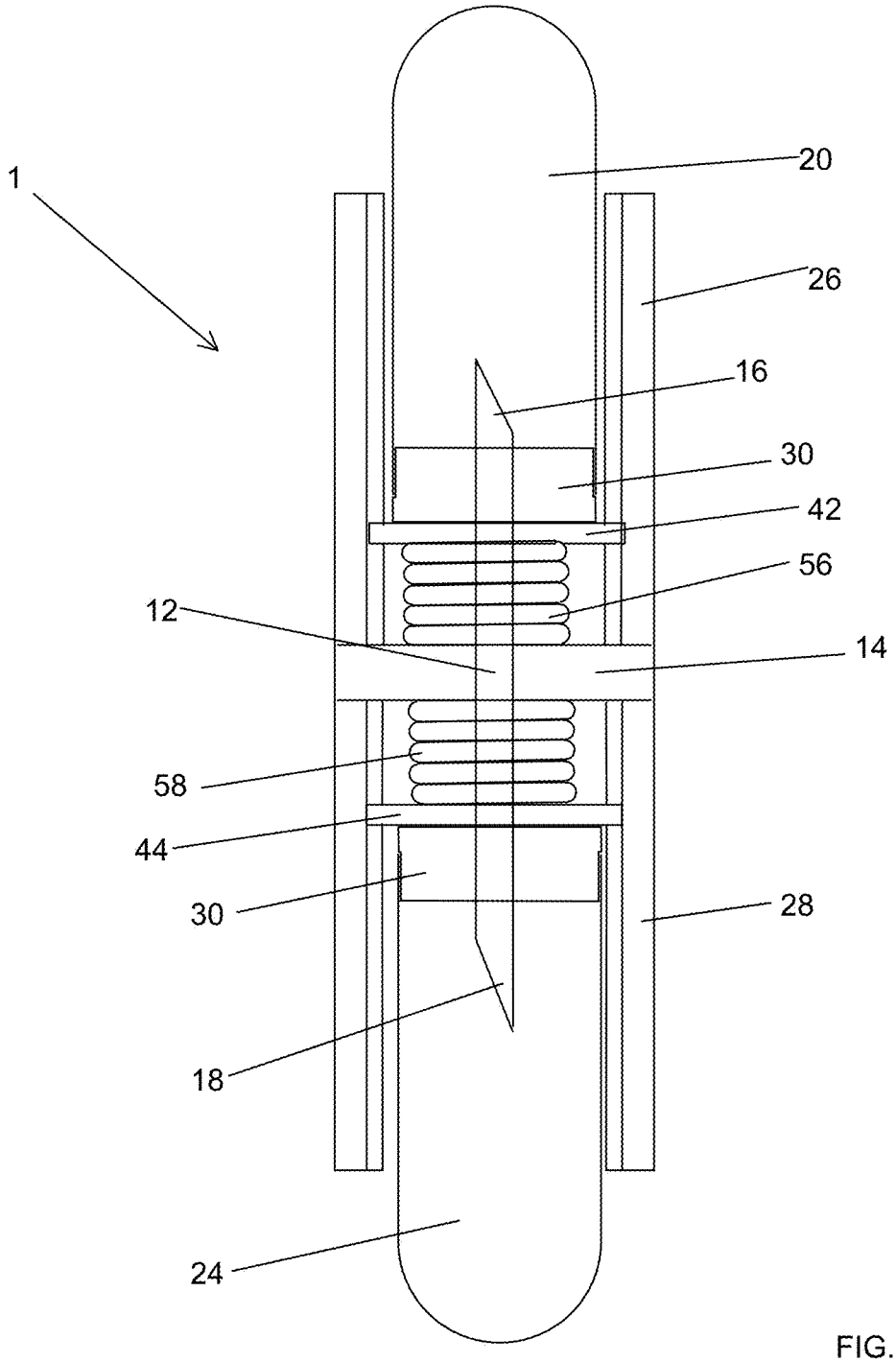
FIG. 5 shows a schematic of an embodiment of a material transfer connector.
Figure 6:
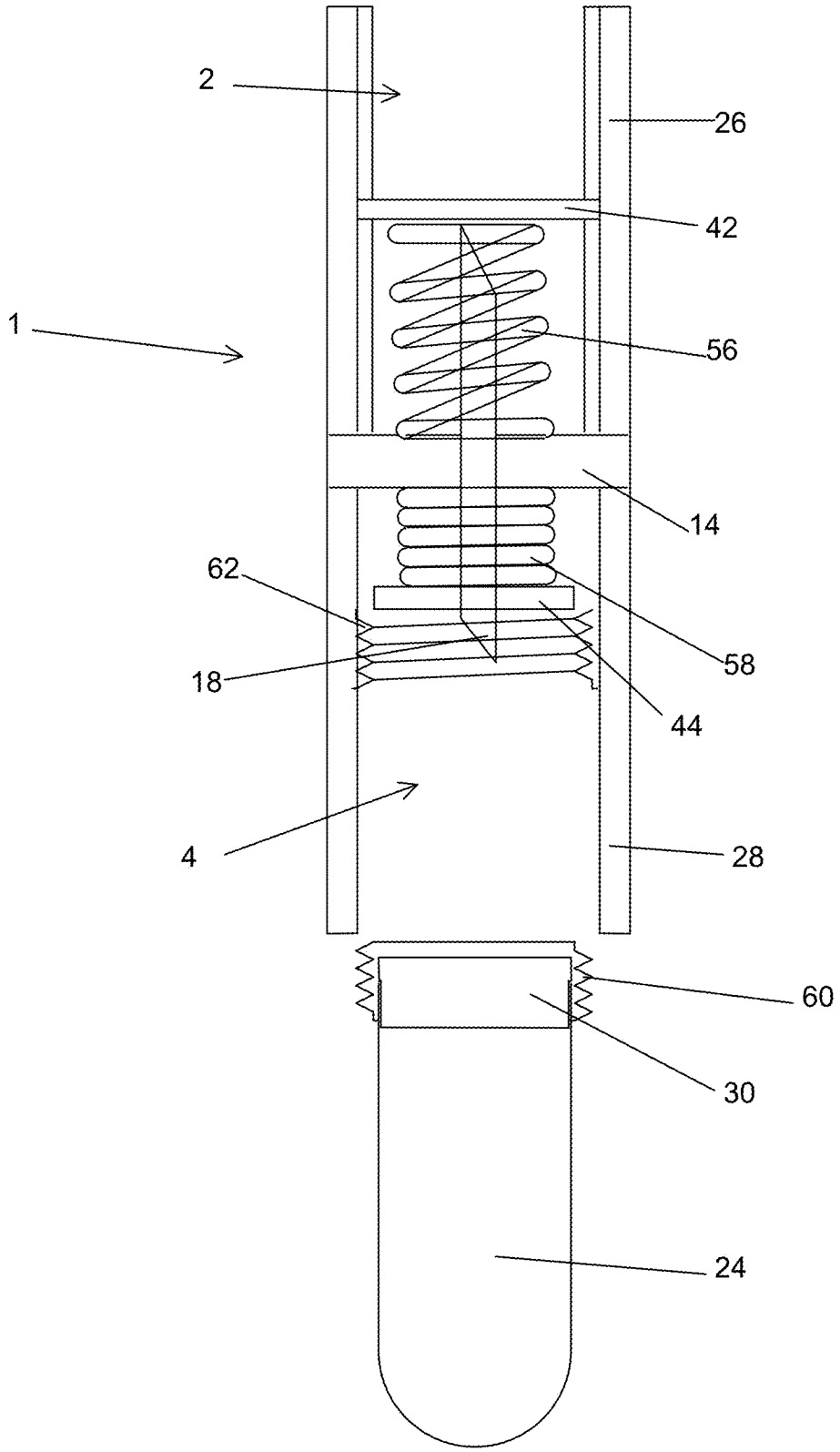
FIG. 6 shows a schematic of an embodiment of a material transfer connector.
Figure 7:
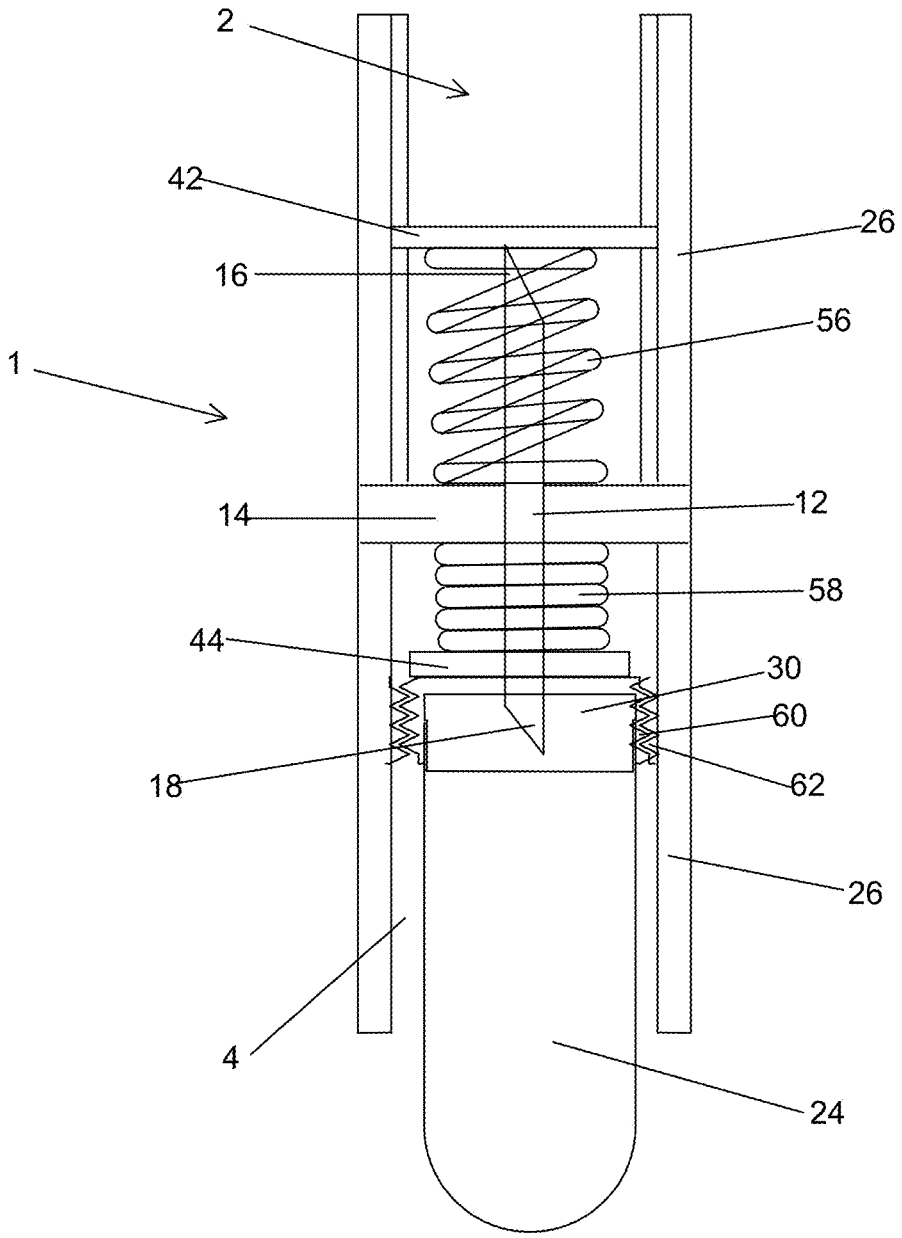
FIG. 7 shows a schematic of an embodiment of a material transfer connector.

As shown in FIGS. 4 and 5, a first container 20 and/or a second container 24 can be moved into the first and/or second opening 2, 4, respectively, along channel 6, to contact the first surface 54 of first and/or second guard 42, 44, respectively. As first and/or second container 20, 24 is further moved in first and/or second opening 2,4, such by moving further toward base 14, the first surface 54 of the first and/or second guard 42, 44 is moved toward the base 14. The movement of first surface(s) 54 can be by way of compressing a compressible material or by compressing a first and/or a second spring 56, 58. Also shown in FIGS. 4 and 5 is first and second tip 16, 18 having entered first and second containers 20, 24 by passing through lid 30 of the first container 20 and the lid 30 of the second container 24. Thread In some embodiments, lid 30 can comprise external threads 60. In some embodiments, external threads 60 can be formed integrally with lid 30 or can be assembled with other parts of lid 30. FIG. 6 shows an embodiment of a material transfer connector 1 with a first container 20 (or a second container 24) where the lid 30 comprises external threads 60. One or more internal surface of first elongate structure 26 (or second elongate structure 28), as shown in FIG. 6 can comprise threads 62 corresponding to external threads 60. FIG. 6 shows the first guard 42 (or second guard 44) in a retracted state, exposing first tip 16 (or second tip 18), and FIG. 7 shows the container engaged with the threads and the duct. In some embodiments of a material transfer connector 1 utilizing connector threads, the first container 20 (or the second container 24) can be moved into first opening 2 (or second opening 4) to a position where external threads 60 engage internal threads 62, relative rotation of material transfer connector 1 and first container 20 (or second container 24) can then move the first container 20 (or second container 24) and lid 30 further into the first opening 2 (or second opening 4) toward base 14, pushing first guard 42 (or second guard 44) toward base 14, exposing first tip 16 (or second tip 18) to first container 20 (or second container 24) and lid 30 (see FIG. 7.) In some embodiments of material transfer connectors 1 utilizing connector threads, the threads can extend further toward the second end 46, 54 of first elongate structure 26 (or second elongate structure 28) than the first surface 54 of first guard 42 (or second guard 44), or the first surface 54 of first guard 42 (or second guard 44) can extend further toward the second end 46, 54 of first elongate structure 26 (or second elongate structure) than the internal threads. In some embodiments, only one of first and second elongate structure 26, 28 comprise internal threads 62. In some embodiments, both first and second elongate structures 26, 28 can include internal threads 62. In some embodiments, only one of first and second container 20, 24 utilize a lid 30 which comprises external threads 60. In some embodiments, both first and second container 20, 24 utilize lids 30 which comprise external threads 60.

EXAMPLES

This disclosure describes systems, devices and methods for combining and mixing of two components. Components can be selected from solids and fluids, with examples including, but not being limited to, lyophilized single or multi-analyte beads and appropriate base matrices (components, whether solid or fluid can include, but are not limited, to water or water-based fluids as as well as solvents or solvent-based fluids and biological fluids and fluid fractions as well as combinations thereof, such as DI water, distilled water, water for injection, saline, D5W, fluid comprising one or more bodily fluid (such as blood, blood fraction (whether from human or animal, such as albumin, immunoglobulin, lipoproteins (such as HDL, LDL VLDL, chylomicrons), cytokines, erythrocytes, monocytes, lymphocytes, neutrophils, eosinophils, lipid stripped serum charcoal stripped serum, serum, cerebrospinal fluid, drainage fluid (such as from a surgical site or a wound), pericardial fluid, peritoneal fluid, pleural fluid, synovial fluid, saliva), dry forms of or comprising one or more component of bodily fluids such as those described herein, tissue or cell culture media or component, bacterial growth media or component, fruit juice or component, swimming pool water or component, sewage water or component, water with additional components, alcohol, solvent, etc. and combinations thereof), utilizing a material transfer connector to prepare a liquid composition, which can be used as quality control material to monitor the performance of clinical laboratory tests. The material transfer connector device can be made of an appropriate material, such as metal, alloy, elastomer or plastic material and combinations thereof. The resulting liquid compositions can be used as controls, reference and proficiency materials, standards, and calibrators. The method of preparation of the two components and the resulting liquid composition will be described in the following example, which is provided to illustrate the invention in a non-limiting manner:

Example 1

Preparation of Lyophilized Analyte Spheres:

Analyte spheres or beads were produced as follows. Small-diameter beads (~3-9 mm) were made from measured amounts of a concentrated liquid (25-250 μL) containing one or multiple analytes by lyophilization.

For preparation of analyte spheres, a solution containing a known concentration of the desired analyte and additives was prepared. The concentration of analyte in the solution used for production of the spheres generally was higher (10 to 1000 times higher) than the target concentration of analyte after reconstitution of the beads in the control. Presented in Table 1 is the formulation of the solution used to prepare analyte beads containing Thyroxine (T4). After combining the compounds shown in Table 1 with DI water, the pH was adjusted to 7.8 using dilute HCl or NaOH.

TABLE 1

Formulation of Solution Used for Preparation of Thyroxine Analyte Beads

| Compound | Concentration |
|---|---|
| Bovine Serum Albumin | 1 g/dL |
| NaCl | 100 mM |
| Hepes Buffer | 20 mM |
| Thyroxine | 880 μg/dL |

Presented in Table 2 are the typical characteristics of the Thyroxine analyte beads prepared from the solution presented in Table 1.

TABLE 2

Thyroxine Bead Characteristics

| Bead | Bead Size Diameter (mm) | Bead Mass (mg) | Analyte Mass in the Bead | Bead to Bead Concentration Variation* (Coefficient of Variation %) |
|---|---|---|---|---|
| Thyroxine | 3.5 | 3.7 | 0.22 μg | 1.6 |

*20 beads were tested 4 times each, for a total of 80 observations, to determine the bead to bead concentration variability.

Preparation of Base Matrix:

A base matrix (for preparation of an analyte solution from the beads of Table 2) was prepared by dissolving and mixing the appropriate amounts of the compounds listed in Table 3 in DI water to achieve their corresponding concentrations in deionized water. The pH of the base matrix was then adjusted to 7.8 using dilute HCl or NaOH. The composition was then aseptically filtered through a 0.2 μm membrane filter into 250-500 mL sterile polystyrene containers, filled and capped in small glass vials (3 or 5 mL each), and stored at 2-8° C. to prevent microbial growth.

TABLE 3

Composition of the Base Matrix

| Compound | Concentration |
|---|---|
| Human Serum Albumin | 5 g/dL |
| NaCl | 100 mM |
| Hepes Buffer | 20 mM |

The endogenous levels of various analytes in the base matrix were then determined using commercially available assays and were found to be below the detection limits of the assays.

A sample of the beads of Table 2 were tested by being stored in a first vial under vacuum. A second vial contained the base matrix described above. The first vial was then opened and the contents were emptied into the second vial with base matrix. The second vial was then capped and mixed by inverting. The contents of the second vial were observed visually and no undissolved material was observed.

Figure 14:
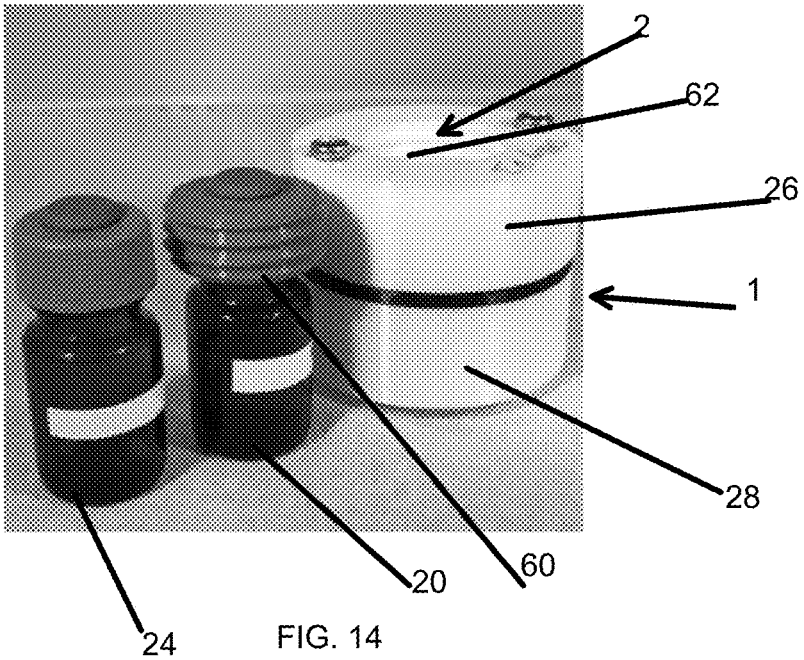
FIG. 14 shows a photograph of an embodiment of a material transfer connector and containers.
Figure 15:
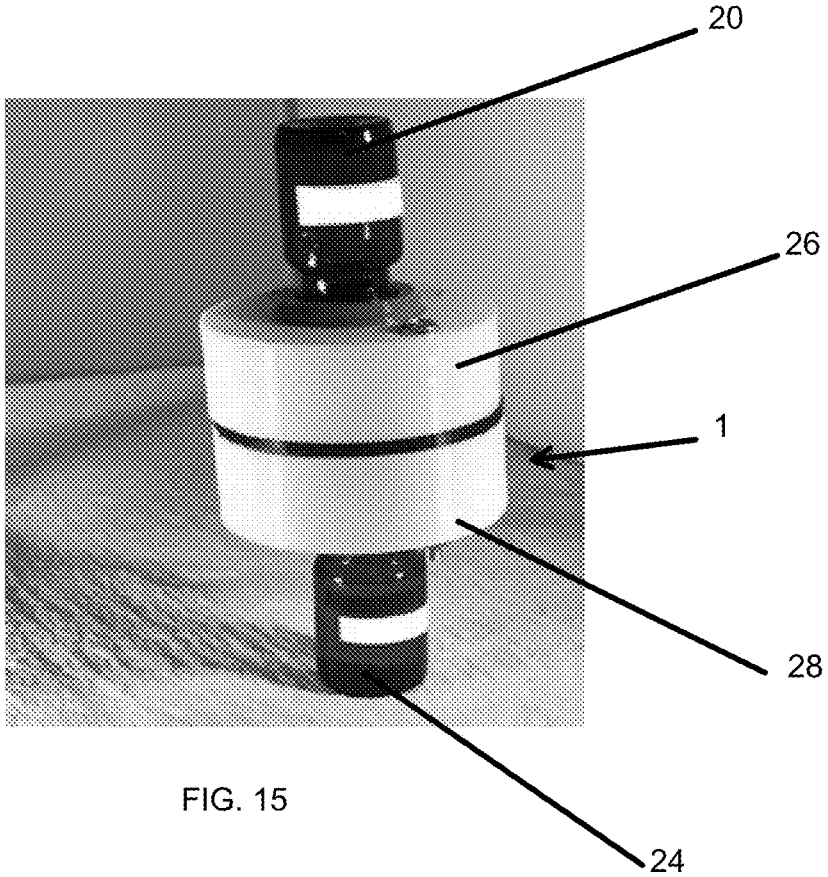
FIG. 15 shows a photograph of an embodiment of a material transfer connector and containers.

The results of this test demonstrate that the beads of Table 2 can be stored in a first vial under vacuum and a combined with a base matrix in a second vial by using a material transfer connector 1. For example, a material transfer connector 1, as shown in FIGS. 14 and 15 which includes a double sided needle (duct 12) shielded from inadvertent needle sticks to the user by two layers of plastic as first and second guards 42, 44 that are held in place by two springs 56, 58, can be used for rehydration of the beads of Table 2 in the base matrix described above. The material transfer connector can also utilize internal threads on a first elongate structure for threaded interaction with the lid of the first container. The structure of the material transfer connector can be similar to that shown in FIGS. 6 and 7 with the first elongate structure 26 having internal threads 62.

Example 2—Preparation of the Control (Prophetic Example)

Presented in FIG. 14 are photographs of a material transfer connector 1 with vials (containers 20, 24) of analyte beads and rehydration fluid. FIG. 15 shows the vials 20, 24 operatively interfaced to the material transfer connector 1 as a part of reconstituting the lyophilized beads to produce the quality control material.

In this preparation of control material, and as shown in FIGS. 14 and 15, the vial (first container 20) containing the bead is a standard 8 mL amber borosilicate glass vial with a butyl rubber stopper and integrated screw cap from West Pharmaceuticals Services, Inc. (Exton, Pa., USA.) The vial (second container 24) containing the rehydration fluid (base matrix) is the same, except that the cap 30, with outside threads 60 as well as inside threads, was fabricated using the same equipment, materials, and software as those used to fabricate the material transfer connector 1.

As described above, the material transfer connector 1 can utilize a double sided needle (duct 12) shielded from inadvertent needle sticks to the user by two layers of plastic as first and second guards 42, 44 that are held in a guard position over the tips of the needle by two springs. The rehydration fluid vial (second container 24) can be first screwed into material transfer connector 1 at first elongate structure 20, puncturing the lid 30. Then, the material transfer connector (first container 20) can be placed on top of the bead vial (second container 24) and pressed down to puncture the lid 30 of the analyte bead(s) vial with duct 12 and form a flow path between the two vials. (In some embodiments, the order of attachment can be reversed.) In some embodiments, the bead(s) can be under vacuum, to facilitate the movement the movement of the fluid into the container holding the bead(s), where when the material transfer connector couples the two vials, the vial containing the analyte bead (e.g. first container) pulls in the material in the second container, such as the rehydration fluid (base matrix). In preferred embodiments, a negligible but reproducible amount of fluid would be retained in the rehydration fluid vial after the transfer.

In some embodiments, the first and/or the second container 20, 24 can be at an elevated pressure, at a vacuum or at atmospheric pressure, with the condition of each container determined independently. When used with the material transfer container 1 in a first preferred embodiment, the first container will be at an elevated pressure and contain material that is to be transferred to the second container, and the second container can be connected to the material transfer connector first, with the pressure in the second container after connection being lower than the pressure in the first container prior to connection, wherein upon connection of the first container, the pressure in the first container will push material from the first container to the second container. Within this first preferred embodiment, the second container can be at a vacuum, at atmospheric pressure or at an elevated pressure prior to connection to the material transfer connector 1.

In a second preferred container, the second container will be the container where the contents of the first container are transferred to, and the second container will be at a vacuum prior to connection to the material transfer container. In this second preferred embodiment, the first container can be connected to the material transfer connector first, with the pressure in the second container prior to connection of the second container to the material transfer connector being lower than the pressure in the first container after the first container is connected to the material transfer connector, wherein the upon connection of the second container to the connector, the vacuum in the second container will draw material from the first container into the second container. Within this second preferred embodiments, the first container can be at vacuum, at atmospheric pressure or at an elevated pressure prior to connection of the first container to the material transfer connector.

In various embodiments, the level of vacuum or pressure of the first and second containers, the needle dimensions as well as the puncture depth of the needle into the container of rehydration fluid can be varied. In some embodiments, the level of vacuum or pressure, the needle dimensions and the puncture depth of the needle into the container of rehydration fluid can be selected to achieve a desired transfer into the bead container or a desired degree of reproducibility in the transfer of rehydration fluid to the bead container.

Example 3—Point-of-Care Usage (Prophetic Example)

Figure 16:
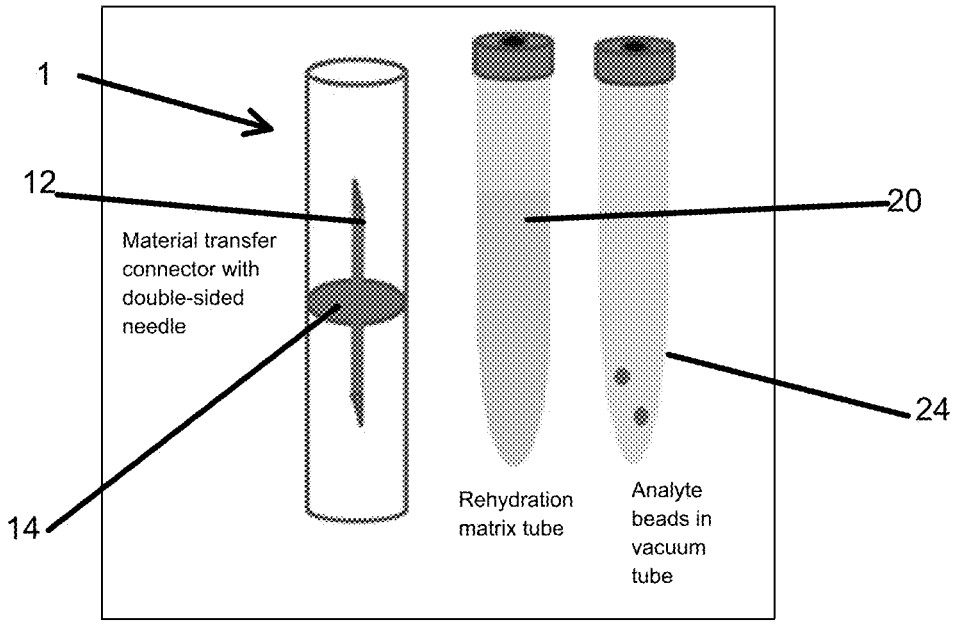
FIG. 16 shows a schematic of an embodiment of a material transfer connector and containers.
Figure 17:
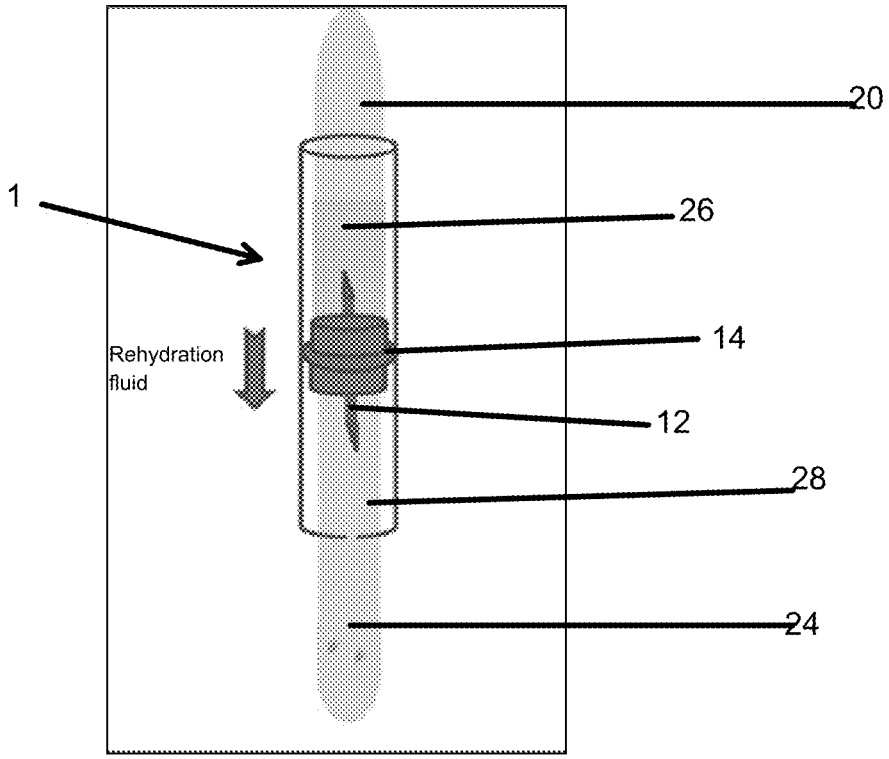
FIG. 17 shows a schematic of an embodiment of a material transfer connector and containers.

A rehydrator as shown in FIGS. 10-13 can be used, for example, in a point-of-care environment. Two tubes (first and second containers 20, 24) can be coupled to one another using a material transfer connector as shown in FIG. 13. Here, one or more of the analyte bead tube and tubes for drawing blood could be under vacuum. The material transfer connector 1 and the first and second containers 20, 24 are shown separated in FIG. 16, and interconnected with rehydration fluid flowing from the first container 20 to the second container 24 and rehydrating the analyte beads.

The dimensions of the material transfer connector (e.g. diameter of the openings for receiving the tubes and the distance from the end of the opening that receives the tube to the tip of the needle can be selected to reduce the possibility of a person using the material transfer connector receiving an inadvertent needle stick because the cylinder is too narrow and/or too long for fingers to enter sufficiently to contact the needle. Such a device can also be inexpensive to manufacture and can be disposable. In use, a technician can insert a tube containing rehydration fluid or blood into one end of the material transfer connector sufficiently to puncture the top of the tube, and then the technician inserts a tube containing analyte beads or other material to be combined with the contents of the first tube into the opposite opening of the material transfer connector sufficiently to pierce the top of this second tube, and the contents of the first tube are allowed to move to the second tube. As with Examples 1 and 2, the level of vacuum/pressure, the dimensions of the needle and the puncture depth can be varied as desired.

Having now described the invention in accordance with the requirements of the patent statutes, those skilled in this art will understand how to make changes and modifications to the present invention to meet their specific requirements or conditions. Such changes and modifications may be made without departing from the scope and spirit of the invention as disclosed herein.

The foregoing Detailed Description of exemplary and preferred embodiments is presented for purposes of illustration and disclosure in accordance with the requirements of the law. It is not intended to be exhaustive nor to limit the invention to the precise form(s) described, but only to enable others skilled in the art to understand how the invention may be suited for a particular use or implementation. The possibility of modifications and variations will be apparent to practitioners skilled in the art. No limitation is intended by the description of exemplary embodiments which may have included tolerances, feature dimensions, specific operating conditions, engineering specifications, or the like, and which may vary between implementations or with changes to the state of the art, and no limitation should be implied therefrom. Applicant has made this disclosure with respect to the current state of the art, but also contemplates advancements and that adaptations in the future may take into consideration of those advancements, namely in accordance with the then current state of the art. It is intended that the scope of the invention be defined by the Claims as written and equivalents as applicable. Reference to a claim element in the singular is not intended to mean "one and only one" unless explicitly so stated. Moreover, no element, component, nor method or process step in this disclosure is intended to be dedicated to the public regardless of whether the element, component, or step is explicitly recited in the Claims.

We claim:

1. A material transfer connector, the material transfer connector comprising:

a base;

a first elongate structure having a first and a second end, the first elongate structure extending from a first side of the base at the first end to the second end distal the base, the second end forming a first opening sized and configured to receive a first container;

a second elongate structure having a third and fourth end, the second elongate structure extending from a second side of the base at the third end to the fourth end distal the base, the fourth end forming a second opening sized and configured to receive a second container;

a duct extending through the base and having a first tip skirted on one or more sides by the first elongate structure and a second tip skirted on one or more sides by the second elongate structure;

a first guard positioned within the first elongate structure, wherein the first guard comprises a first surface, and the first surface is located further away from the base than the first tip;

a first spring located between the base and the first guard and biasing the first guard away from the base;

a second guard positioned within the second elongate structure, wherein the second guard comprises a second surface, and the second surface is located further away from the base than the second tip; and a second spring located between the base and the second guard and biasing the second guard away from the base, wherein, when the first container is moved into the first opening, the first surface moves toward the base, and the first tip enters the first container, and when the second container is moved into the second opening, the second surface moves toward the base, and the second tip enters the second container, creating a fluid path between the first and the second containers.

2. The material transfer connector of claim 1, wherein the first elongate structure aligns the first container radially and angularly with the duct and the second elongate structure aligns the second container radially and angularly with the duct.

3. The material transfer connector of claim 1, wherein the first container comprises a first top comprising a first fluid barrier and the first tip passes through the first fluid barrier and the second container comprises a second top comprising a second fluid barrier and the second tip passes through the second fluid barrier.

4. The material transfer connector of claim 1, wherein the first elongate structure comprises threads on a first inner surface, and the threads of the first elongate structure are configured to threadably interact with threads on an outer surface of the first container.

5. The material transfer connector of claim 4, wherein the second elongate structure comprises threads on a second inner surface, and the threads of the second elongate structure are configured to threadably interact with threads on an outer surface of the second container.

6. The material transfer connector of claim 1, wherein the first container contains a reagent and the second container contains a solvent for the reagent.

7. The material transfer connector of claim 1, wherein the first elongate structure is cylindrical and encircles the first tip.

8. The material transfer connector of claim 7, wherein the second elongate structure is cylindrical and encircles the second tip.

9. The material transfer connector of claim 1, wherein the first guard is compressible.

10. A method of transferring a fluid between containers, the method comprising:

moving a first container into the first opening of the material transfer connector of claim 1, whereby the first surface moves toward the base and the first tip enters the first container and creates a fluid path between the first container and a second container present in the second opening; and transferring fluid between the first and second containers.

11. A method of transferring a fluid between containers, the method comprising:

transferring a fluid from a first container present in the first opening of the material transfer connector of claim 1 to a second container present in the second opening of the material transfer connector of claim 1.

12. A material transfer connector, the connector comprising:

a base;

a first elongate structure having a first and a second end, the first elongate structure extending from a first side of the base at the first end to the second end distal the base, the second end forming a first opening sized and configured to receive a first container;

a duct extending through the base and having a first tip skirted on one or more sides by the first elongate structure;

a first guard positioned within the first elongate structure, wherein the first guard comprises a first surface, and the first surface is located further away from the base than the first tip;

a first spring located between the base and the first guard, the first spring biasing the first guard away from the base; and wherein, when the first container is moved into the first opening, the first surface moves toward the base, and the first tip enters the first container, creating a fluid path for the first container.

13. The material transfer connector of claim 12, wherein the first elongate structure aligns the first container radially and angularly with the duct.

14. The material transfer connector of claim 12, wherein the first container comprises a first top comprising a first fluid barrier and the first tip passes through the first fluid barrier.

15. The material transfer connector of claim 12, wherein the first elongate structure comprises threads on a first inner surface, and the threads of the first elongate structure are configured to threadably interact with threads on an outer surface of the first container.

16. The material transfer connector of claim 12, wherein the first elongate structure is cylindrical and encircles the first tip.

* * * * *